US009834423B2

(12) United States Patent
Magni

(10) Patent No.: US 9,834,423 B2
(45) Date of Patent: Dec. 5, 2017

(54) LIFT TRUCK EQUIPPED WITH STABILIZER MEANS

(71) Applicant: C.M.C. S.R.L.—SOCIETA UNIPERSONALE, Castelfranco Emilia, Modena (IT)

(72) Inventor: Riccardo Magni, Modena (IT)

(73) Assignee: C.M.C. S.R.L.—SOCIETA UNIPERSONALE, Modena (IT)

( * ) Notice: Subject to any disclaimer, the term of this patent is extended or adjusted under 35 U.S.C. 154(b) by 0 days.

(21) Appl. No.: 14/782,574

(22) PCT Filed: Apr. 1, 2014

(86) PCT No.: PCT/IB2014/000457
§ 371 (c)(1),
(2) Date: Oct. 5, 2015

(87) PCT Pub. No.: WO2014/162191
PCT Pub. Date: Oct. 9, 2014

(65) Prior Publication Data

US 2016/0039648 A1 Feb. 11, 2016

(30) Foreign Application Priority Data

Apr. 5, 2013 (IT) ..... MO2013A0087

(51) Int. Cl.
*B66C 23/80* (2006.01)
*B66F 9/075* (2006.01)
*B66F 9/065* (2006.01)

(52) U.S. Cl.
CPC ..... *B66F 9/07559* (2013.01); *B66C 23/80* (2013.01); *B66F 9/0655* (2013.01)

(58) Field of Classification Search
CPC ..... B66C 23/80; B66F 9/06; B66F 9/0655
(Continued)

(56) References Cited

U.S. PATENT DOCUMENTS 3,958,813 A 5/1976 Carey
4,124,226 A * 11/1978 Phillips ..... B66C 23/80 180/41
6,409,457 B1 * 6/2002 Korycan ..... B60P 1/167 180/242

FOREIGN PATENT DOCUMENTS

GB 2 392 431 A 3/2004
JP 2010-001097 A 1/2010

OTHER PUBLICATIONS

International Search Report and Written Opinion of PCT/IB2014/000457 dated Jun. 27, 2014.

* cited by examiner

*Primary Examiner* — Scott Lowe
*Assistant Examiner* — Ronald Jarrett
(74) *Attorney, Agent, or Firm* — Arent Fox LLP

(57) ABSTRACT

A lift truck comprises a chassis (1) movable on wheels (2) and a rotating platform (3) which supports an operating arm (4); stabilizing means are provided for resting on the ground and positioned at the front as well as at the back. The stabilizing means consist of two pairs of two telescopically extensible arms (5), each one comprising a first segment (6) and a second segment (7). The arms (5) have their ends hinged to opposite sides of the chassis (1), so as to swivel about parallel axes, and have the opposite free ends intended to lean against the ground by means of plates or stabilizing feet (8). The two arms (5) of each pair are arranged side by side at a short distance from each other on parallel planes and are individually bound to the chassis (1) by means of hydraulic cylinders (11). Control means are provided to control at least the return movements of each pair of arms (5) to a folded, contracted configuration, according to a predetermined sequence which provides that, for each single arm (5), full retraction of a respective second segment (7), at
(Continued)

least for a predetermined portion of the final part of its return stroke, is carried out only after that the first segment (6) of the other arm (5), belonging to the same said pair of arms (5), has reached a final folding position.

7 Claims, 4 Drawing Sheets

(58) Field of Classification Search
USPC ..... 414/687
See application file for complete search history.

LIFT TRUCK EQUIPPED WITH STABILIZER MEANS

CROSS-REFERENCE TO RELATED APPLICATION

This application is a National Stage entry of International Application No. PCT/IB2014/000457, filed Apr. 1, 2014, which claims priority to Italian Patent Application No. MO2013A000087, filed Apr. 5, 2013. The disclosures of the priority applications are incorporated in their entirety herein by reference.

The present invention relates to a lift truck equipped with stabilizing means for resting on the ground.

More precisely, the invention finds its preferred, but not exclusive, collocation in the field of lift trucks equipped with an operating arm, which consists of a telescopic arm rotating about a vertical axis and mounted on a rotating platform. The platform is arranged on a wheeled mobile chassis.

Lift trucks are known of this type. They are equipped with stabilizer means having the function of ensuring an adequate and secure support on the ground during the working phase, i.e. when rotating operating arm is in operation. These means can then be moved to a working position, in which support the whole machine, and a collapsed inactive position, in which they are folded, so as keep the whole machine within the encumbrance configuration permitted by the regulation for the drive on the road.

These stabilizer means often include extensible or foldable outriggers provided with stabilizing plates or feet, which, in the operation configuration, rest on the ground in order to outline a support polygon, the extent and shape of which essentially determine the ability of the machine to operate safely. The greater the support polygon, the greater the operational capacity of the machine that has its anti tipping characteristics increased. The more regular the perimeter of such a support polygon, the more "uniform" is the practicality of the machine in relation to the possibility of using the operating arm with any orientation with respect to a vertical axis.

Outriggers are known, commonly referred to as "scissor outriggers", which are arranged at the front as well as at the back on a wheeled chassis of a lift truck equipped with a swiveling operating arm; each "scissors outrigger" include a pair of telescopically extensible arms which have respective ends, opposite to those intended to rest on the ground by means of stabilizer plates or feet, respectively hinged in positions situated near opposite sides of the chassis, so as to swivel about parallel axes. The two arms of each pair are arranged side by side at short distance from each other, operate in planes parallel to each other and are individually bound to the chassis by means of hydraulic cylinders which have their closed sides of their first sections hinged to the chassis and have stabilizer plates or feet hinged to the ends of their second segments or stems. These telescopically extensible arms have only a single extension and have remarkable characteristics of simplicity and robustness. In the totally retracted position, they normally take a horizontal, or nearly horizontal position. In this configuration, the arms, including the stabilizer plate or feet which are freely pivoted at their ends, must not jut out from the transversal outline allowed for the truck.

In known applications of this type, the passage from the collapsed or rest position, to the operation position with the arms extended and resting on the ground, as well as the return motion from the operation position to the rest position, are carried out through operation of the same actuators, which consist of hydraulic cylinders linking the telescopically extensible arms to the chassis, and by similar actuators that control extension and return of the outriggers. While collapsing, that is during the return stroke from the extended position to the collapsed rest one, in order to avoid possible interferences between the plate hinged to the end of the second segment of an outrigger and the end of the other arm, hinged to the chassis, the plate must be situated at a considerable distance from the outline allowed for the truck.

This geometric condition causes a limitation of the length of the first segment of the outrigger, and therefore a limitation length of the arm itself and, consequently, of the support polygon on the ground.

The present invention as is described and claimed in the following, has the main object to overcome such a limitation.

An advantage of the invention consists in the construction and functional simplicity.

Further features and advantages of the present invention will better appear from the detailed description of a preferred embodiment shown, by way of not limited example, in the accompanying figures, in which.

Figure 1:
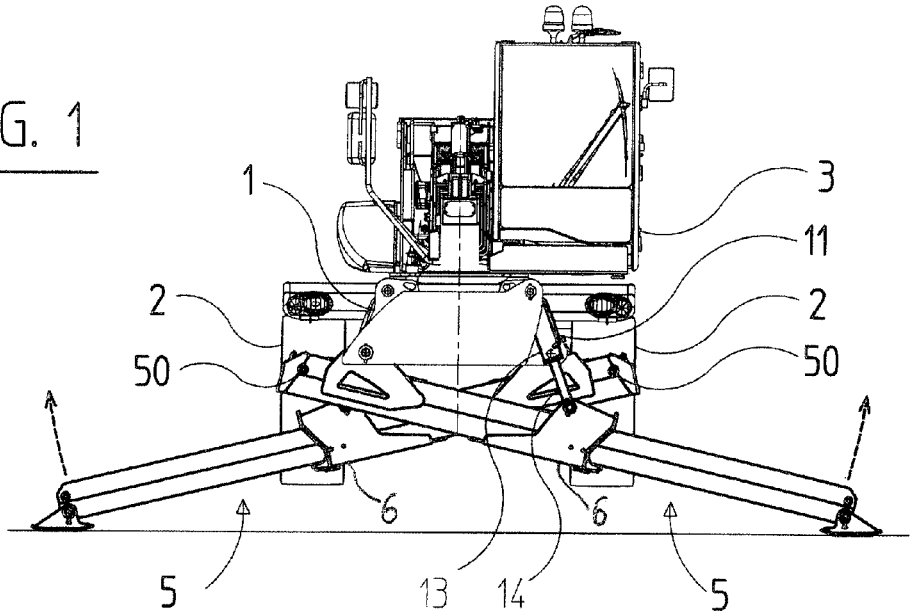
FIG. 1 shows a front view of a lift truck in which the stabilizer means according to the invention are played up in the maximum extension operation configuration.

In the accompanying figures there is shown a lift truck equipped with stabilizing means designed for resting on the ground.

In particular, the lift truck comprises a chassis 1 movable on wheels 2 and a rotating platform 3 which supports an operating arm 4.

The chassis 1 is provided, at the front as well as at the back, with stabilizer means consisting of two pairs of two telescopically extensible arms or outriggers 5, which have respective ends, opposite to those intended to rest on the ground by means of stabilizer plates or feet 8, hinged in positions situated near opposite sides of the chassis 1, so as to swivel about parallel axes by means of pivots 50. These axes are parallel to the longitudinal axis of the truck. In this way, the two arms 5 of each pair move in planes parallel to each other. Moreover, the two arms are arranged side by side at a short distance from each other, so that they do not interfere with each other. Each arm 5 is of the type with only a single extension because it includes a first segment 6, by which the arm is pivoted to the chassis 1, and a second segment 7 which can be extracted from the first segment, provided with stabilizing plates or feet 8 simply hinged at its free end.

Figure 6:
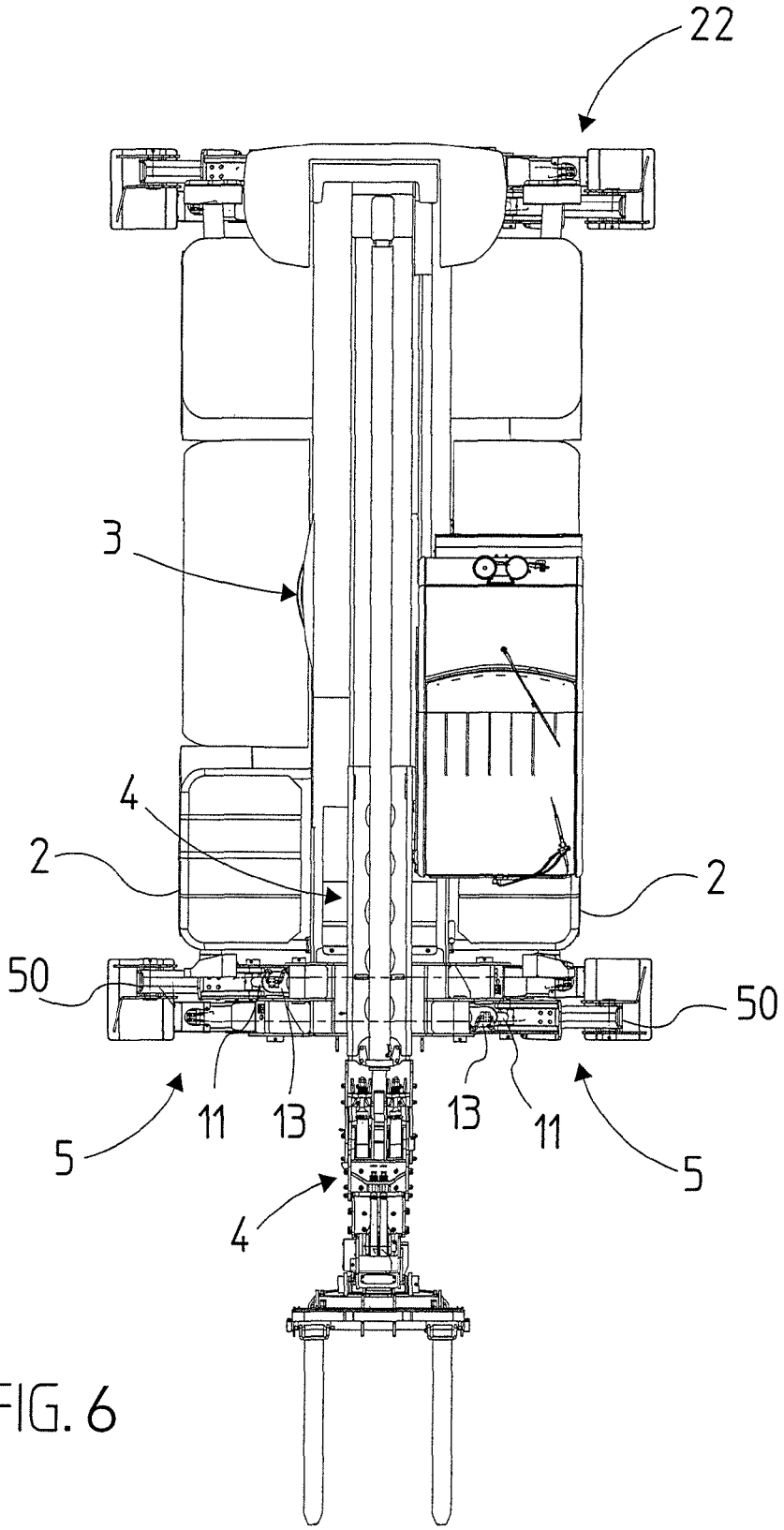
FIG. 6 shows a simplified top view of the lift truck showing the front and rear extensible arms according to one example implementation.

Both the first segment 6 and the second segment 7 consist of strong beams which form a telescopic assembly. It is noted that as shown in FIG. 6, the stabilizer means 22 at the back of the lift truck may have similar structure to the front pair of telescopically extensible arms described above and throughout the specification.

The arms 5 are also individually bound to the chassis 1 by means of hydraulic cylinders 11 which have their closed sides of their first sections 13 hinged to the chassis 1, and have the ends of their stems 14, which can be extracted from the respective first sections 13, hinged to the first sections 6 of the corresponding arms 5.

The arms 5 are preferably bound to the chassis 1 with a symmetrical arrangement with respect to a median plane of the truck which contains its longitudinal axis.

The stabilizing plates or feet 8 are pivoted to the second sections 7 of the arms 5, on pivots that have axes parallel to the pivots 50.

A hydraulic actuator is mounted between the first segment 6 and the second segment 7 and works coaxially to produce extension and retraction. The activation of the arms 5 as well as that of the hydraulic cylinders 11 are therefore implemented hydraulically.

Control means are provided to control at least the return movements of each pair of arms 5 to a folded, collapsed configuration, according to a predetermined sequence which provides that, for each single arm 5, full retraction of the respective stem 7, at least for a predetermined portion of the final part of its return stroke, is carried out only after that the first segment 6 of the other arm 5, belonging to the same said pair of arms 5, has reached or almost reached the final folding position.

This predetermined portion of the final part of the return stroke of the single stem 7 is determined as a function of the geometric and dimensional characteristics of the various elements, in order to avoid possible interferences 20 between the plate 8, hinged to the end of the second segment of an arm 5 and the end, hinged to the chassis, of the first segment 6 of the other arm 5, set therebeside to form the pair of telescopically extensible arms 5. In particular,
said predetermined portion of the final part of the return stroke of the single stem 7 is actually determined so that the distance between the plate or foot 8 of the stem 7 of the single arm 5 and the end of the first segment 6 of the other arm 5 of the same pair of arms 5 is positive or at least is not negative, that is, such as to not generate interference 20 between said plate or foot 8 and said first segment 6, in each intermediate configuration taken by the first segment 6 between the one of maximum extension and the one of minimum extension of the hydraulic cylinders 11.

Determined this factor, which is essentially a factor given by the geometry of the system, it will be sufficient to control the sequence of return movements of each second segment 7 as a function of the return of the stem 14 of the corresponding hydraulic cylinder 11. Such movements in sequence can be programmed and managed by means of a control unit.

In this regard, a sequence can naturally also be provided, that can be defined as simplified, according to which the return phase of the second segment 7, with respect to the relative first segment 6, starts only after that the first segment 6 of the other arm has reached the collapsed position.

The control means designed to control at least the return movements of each pair of arms 5 to the collapsed configuration include a position transducer associated with each arm 5 which informs the control unit about the position of the second segment 7 with respect to the first segment 6.

Tilting of the plate 8 occurs when the arms 5 are completely folded, due to the action exerted by an abutment 15 on the same plate in the very last stage of the return stroke of the second segment 7 in the corresponding first segment 6.

Figure 2:
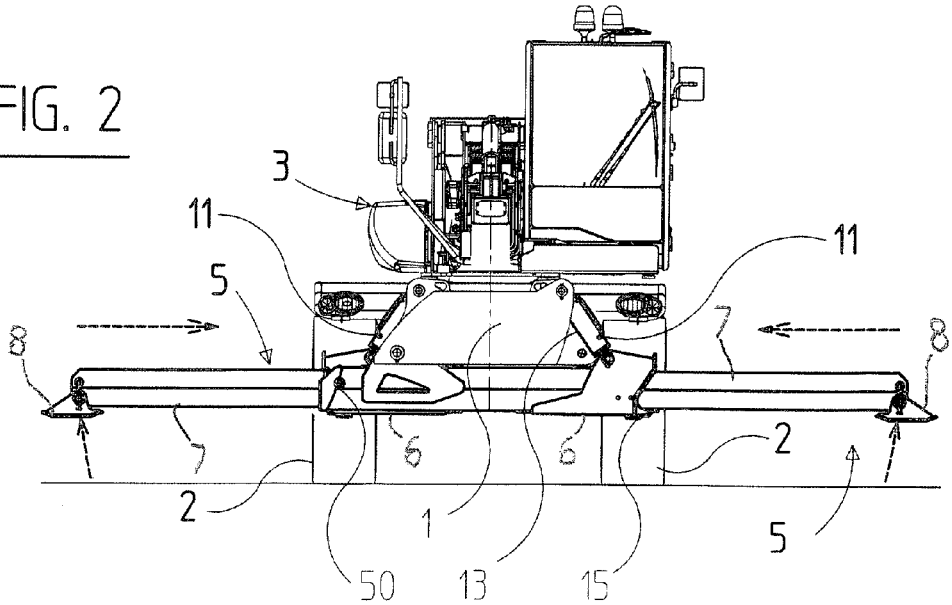
FIG. 2 shows the same view as FIG. 1 with the stabilizer means at an intermediate stage during the return stroke towards the rest position.
Figure 3:
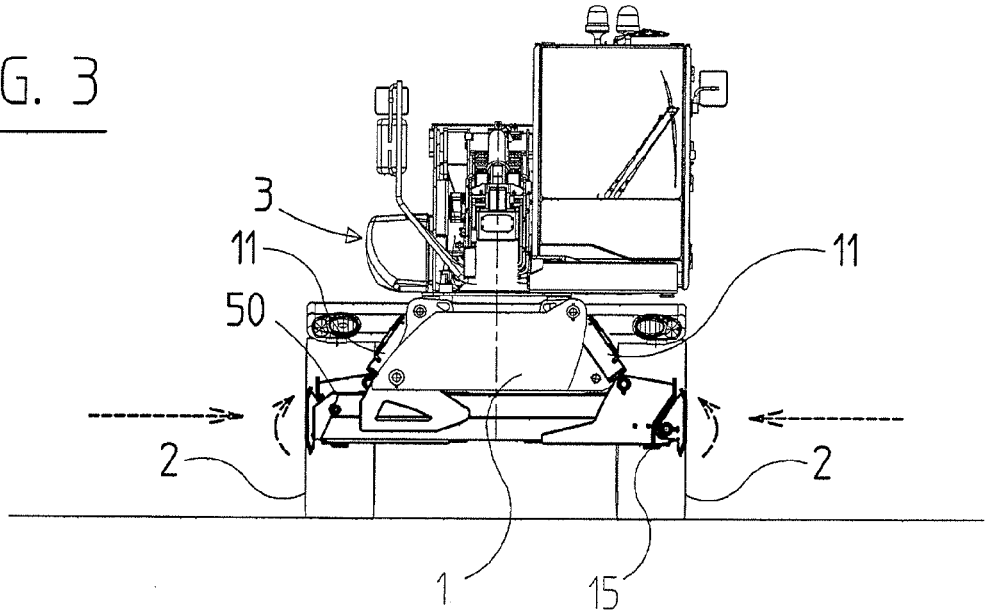
FIG. 3 shows the same view as FIG. 1 with the stabilizer means in a completely collapsed or closed position.
Figure 4:
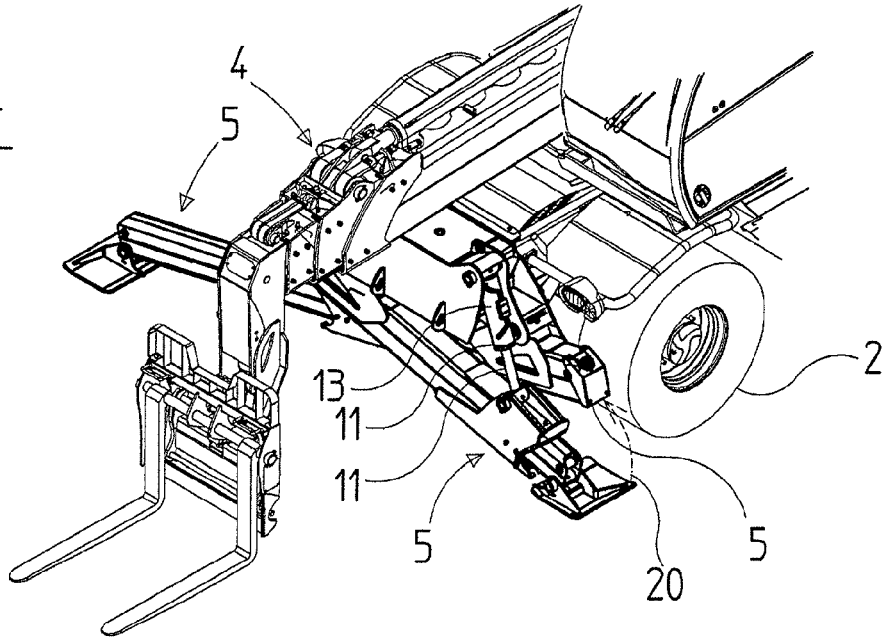
FIG. 4 shows part of a schematic perspective view of the stabilizing means at an intermediate folding stage which is not allowed, because it causes an interference situation.
Figure 5:
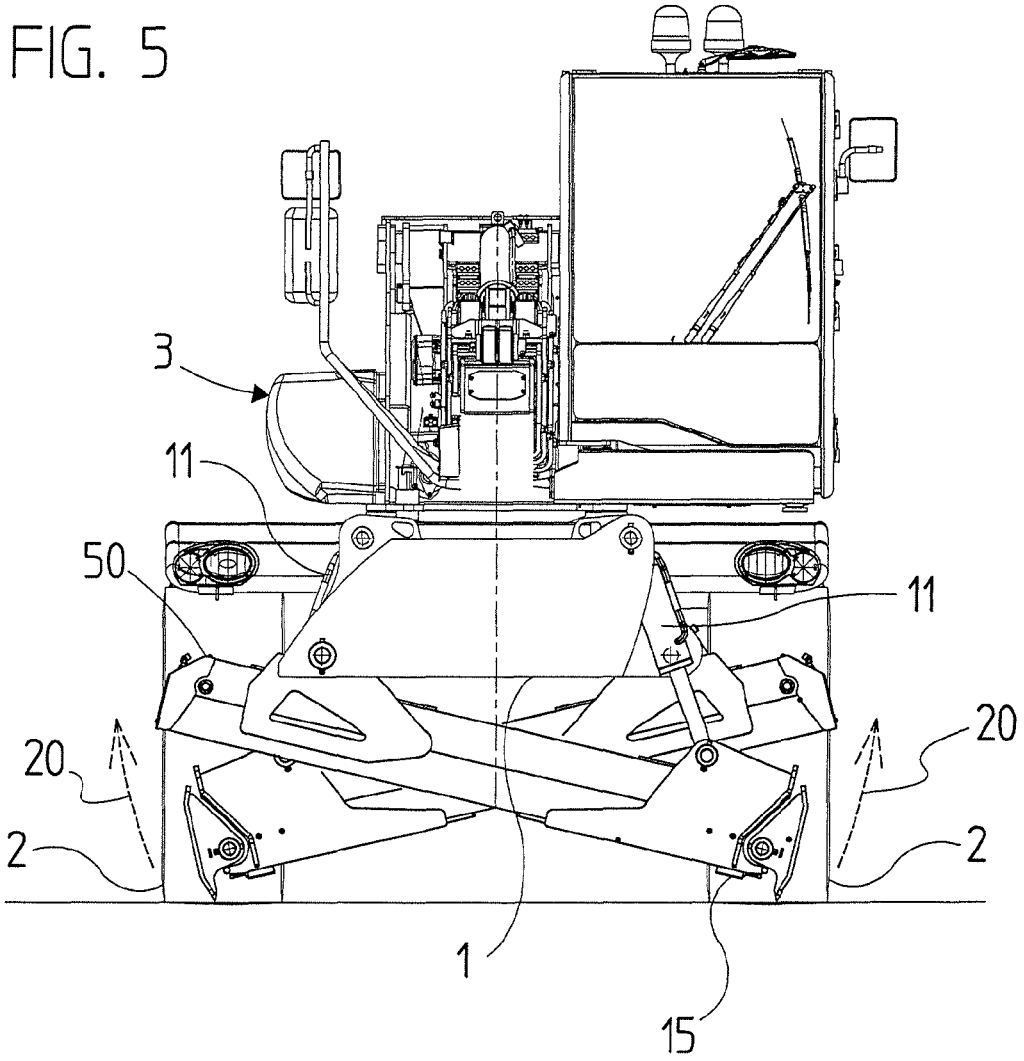
FIG. 5 shows a front view of the lift truck showing an interference situation.

The sequence of return movements, three steps of which are shown in FIGS. 1, 2, and 3, show that the invention permits to place the hinge points of the first sections 6 of the arms 5 very close to the lateral vertical planes which define the encumbrance allowed for the vehicle. This situation, which would not be possible while adopting a sequence of "traditional" movements, like the one shown as example in FIG. 4, allows to use arms 5 with the maximum length, and therefore, with the same conditions, the maximum extension of the support polygon with apparent operational advantages that this entails.

The invention claimed is:

1. A lift truck equipped with a stabilizer portion including a chassis, movable on wheels, on which a rotating platform is mounted and accommodates an operating portion; said chassis being provided, at the front as well as at the back, with two pairs of two telescopically extensible arms each arm having a first segment and a second segment telescopically coupled to the first segment, and each segment having a fully extended and a fully retracted position, wherein the second segment further includes a respective second end, opposite to a first end, the first end having a portion capable of resting on the ground, by means of stabilizer plates or feet having a ground contact plate, wherein each first segment includes a first end and a second end, wherein the first end is closer to the respective stabilizer plate or foot than the second end; the arms are respectively hinged at positions situated near opposite sides, in a widthwise direction, of the chassis, so as to swivel about parallel axes; the two arms of each pair are further arranged side by side a short distance from each other and acting in planes parallel to each other; said arms being also individually bound to the chassis by means of hydraulic cylinders which have closed sides of their first sections hinged to the chassis and have distal ends of their stems hinged to the first segments of the corresponding arms; a control mechanism to control at least the return movements of each pair of said arms to a folded, contracted configuration according to a predetermined sequence which provides that, for each single arm, full retraction of the respective second segment, telescopically coupled to the first segment, is carried out, at least for a predetermined portion of the final part of its return stroke, after that the first segment of the other arm, belonging to the same said pair of arms, has reached a folded position;

characterized in that said predetermined portion of the final part of the return stroke of the single second segment is determined so that the plate or foot of the second segment of the single arm and the second end of the first segment of the other arm of the same pair of arms do not move to mutually interfering positions in said widthwise direction during said retraction, such as to not cause interference in operation between said ground contact plate and said first segment, in each intermediate configuration taken by the first segment between the one of maximum extension and the one of minimum extension of the hydraulic cylinders, wherein the arms are constructed such that each ground contact plate is capable of overlapping and interfering with the second end of the opposite extensible arm.

2. A lift truck according to claim 1, characterized in that the telescopically extensible arms of said two pairs of arms have their respective ends, opposite to those intended to rest on the ground by means of stabilizer plates or feet, respectively hinged to the chassis in diametrically opposed positions with respect to the vertical median plane which contains the longitudinal axis of the truck.

3. A lift truck according to claim 1, characterized in that the control mechanism controls at least the return movements of each pair of said telescopically extensible arms to a folded contracted configuration, wherein the predetermined sequence further provides that, for each single arm, full retraction of the respective second segment, is carried out, at least for the predetermined portion of the final part of its return stroke, only after that the first segment of the other arm, belonging to the same said pair of arms, has reached a final folded position, wherein the control mechanism further includes a position transducer associated with each said arm which report to a control unit the position of the second segment relative to the first segment.

4. A lift truck according to claim 3, characterized in that said arms have such dimension and are located relative to the chassis so that in the contracted or folded, minimum space configuration they do not protrude from the outline of the overall front dimension of the truck.

5. A stabilizer mechanism for use on a vehicle having a chassis, the chassis having a length, a width and a center with respect to a width, the stabilizer mechanism comprising:

a first telescopically extendable arm and a second telescopically extendable arm pivotally mounted to the chassis; wherein the first telescopically extendible arm is pivotally mounted at a portion of the chassis on a first side of said center in a width direction and extends past the center of the chassis to a second side in the width direction; and the second telescopically extendible arm is pivotally mounted at a portion of the chassis on a second side with respect to said center in the width direction and extends past the center of the chassis to the first side in the width direction, each of the first and second telescopically extendible arms further comprises:

a first segment and a second segment telescopically coupled to the first segment, wherein the second segment comprises an inboard end and outboard end, wherein an outboard end of the second segment further comprises a pivotally mounted stabilizer foot having a ground contact plate, wherein the first segment has a first end and a second end, wherein the first end is more proximal to the respective stabilizer foot than the second end, wherein the first segment further comprises a pivotally mounted hydraulic cylinder having a second end mounted to the chassis, wherein the stabilizer mechanism further comprises:

a control mechanism for controlling each of the first and second telescopically extendable arms, the control mechanism controlling a retraction of each of the first and second segment of each arm, such that during the retraction of the first and second segments, the ground contact plate of the stabilizer foot of the first telescopically extendable arm does not move to a position where the the ground contact plate interferes with the first segment of the second telescopically extendable arm, wherein the telescopically extendible arms are constructed such that the ground contact plate of the second telescopically extendible arm is capable of overlapping and interfering with the second end of the first telescopically extendible arm.

6. The stabilizer mechanism of claim 5, wherein the first telescopically extendable arm comprises two telescopically extendible arm portions that are mounted to a front and back of the chassis in a lengthwise direction, and the second telescopically extendable arm comprises two telescopically extendible arm portions that are mounted to a respective front and back of the chassis in a lengthwise direction.

7. The stabilizer mechanism of claim 5, wherein the control mechanism further includes a position transducer associated with each telescopically extendible arm, and wherein the transducer provides position information for the second segment relative to the first segment to the control mechanism.

* * * * *